US011268479B2

(12) United States Patent
Krup

(10) Patent No.: US 11,268,479 B2
(45) Date of Patent: Mar. 8, 2022

(54) ROLLOVER SHUTOFF VALVE ASSEMBLY FOR CARBURETOR

(71) Applicant: William R. Krup, Mount Carmel, IL (US)

(72) Inventor: William R. Krup, Mount Carmel, IL (US)

( * ) Notice: Subject to any disclaimer, the term of this patent is extended or adjusted under 35 U.S.C. 154(b) by 0 days.

(21) Appl. No.: 16/831,132

(22) Filed: Mar. 26, 2020

(65) Prior Publication Data

US 2020/0318577 A1 Oct. 8, 2020

Related U.S. Application Data

(60) Provisional application No. 62/827,944, filed on Apr. 2, 2019.

(51) Int. Cl.
*F02M 5/04* (2006.01)

(52) U.S. Cl.
CPC ..... *F02M 5/04* (2013.01)

(58) Field of Classification Search
CPC ..... F02M 5/02; F02M 5/04; F02M 5/12
USPC ..... 123/359, 397, 398, 198 D, 198 DB
See application file for complete search history.

(56) References Cited

U.S. PATENT DOCUMENTS 7,886,759 B2 * 2/2011 Miyoshi ..... F16K 24/042 137/202
10,473,065 B2 * 11/2019 Takahashi ..... B60K 15/035
2019/0390787 A1 * 12/2019 Suzuki ..... B60W 40/076

* cited by examiner

*Primary Examiner* — Hai H Huynh
(74) *Attorney, Agent, or Firm* — Stinson LLP

(57) ABSTRACT

A rollover shutoff valve assembly used with a carburetor inhibits leaking of fuel from the carburetor in circumstances where the vehicle has rolled over so that the carburetor is inverted from the normal operating position. The rollover shutoff valve assembly includes a fluid passage, a race and a plug received in the race. The plug is movable in the race to inhibit liquid flow through the passage when the shutoff valve assembly rotates from an upright position to an inverted position. The races are closed except at the passage.

19 Claims, 17 Drawing Sheets

ROLLOVER SHUTOFF VALVE ASSEMBLY FOR CARBURETOR

STATEMENT OF RELATED CASES

This application is a continuation of U.S. Ser. No. 62/827,944, filed Apr. 2, 2019, the entire contents of which are incorporated herein by reference.

FIELD

The present disclosure relates generally to a valve assembly for inhibiting fuel leakage from a carburetor in the event of a vehicle rollover.

BACKGROUND

Carburetors are used to deliver a fuel-air mixture to an engine for combustion. Carburetors typically include a main body through which a stream of air from the air intake passes to the manifold, and in which gasoline is fed into the air stream. A fuel bowl holding a reservoir of gasoline is mounted on the main body by a meter block through which a measured flow of gasoline is aspirated from the fuel bowl to the air stream in the main body. One face of the meter block forms a wall of the fuel bowl which is usually about halfway immersed in the gasoline in the fuel bowl. The opposite face of the meter block engages the main body at an interface. A typical meter block includes a plurality of passages that extend from the fuel bowl face through the main body face to fluidly connect the interior of the fuel bowl to the interior of the main body. These passages can include fuel delivery passages, venting passages, air bleed passages and the like. The fuel bowl and the passages through the meter block are arranged so that liquid fuel cannot escape the carburetor when it is in an upright orientation. But when a vehicle is involved in a rollover collision that inverts the carburetor, fuel from the fuel bowl can flow through the passages in the meter block, into the carburetor main body and outside of the carburetor, where it can create a serious combustion hazard.

BRIEF DESCRIPTION OF THE DRAWINGS

Corresponding reference characters indicate corresponding parts throughout the drawings.

DETAILED DESCRIPTION

Figure 1:
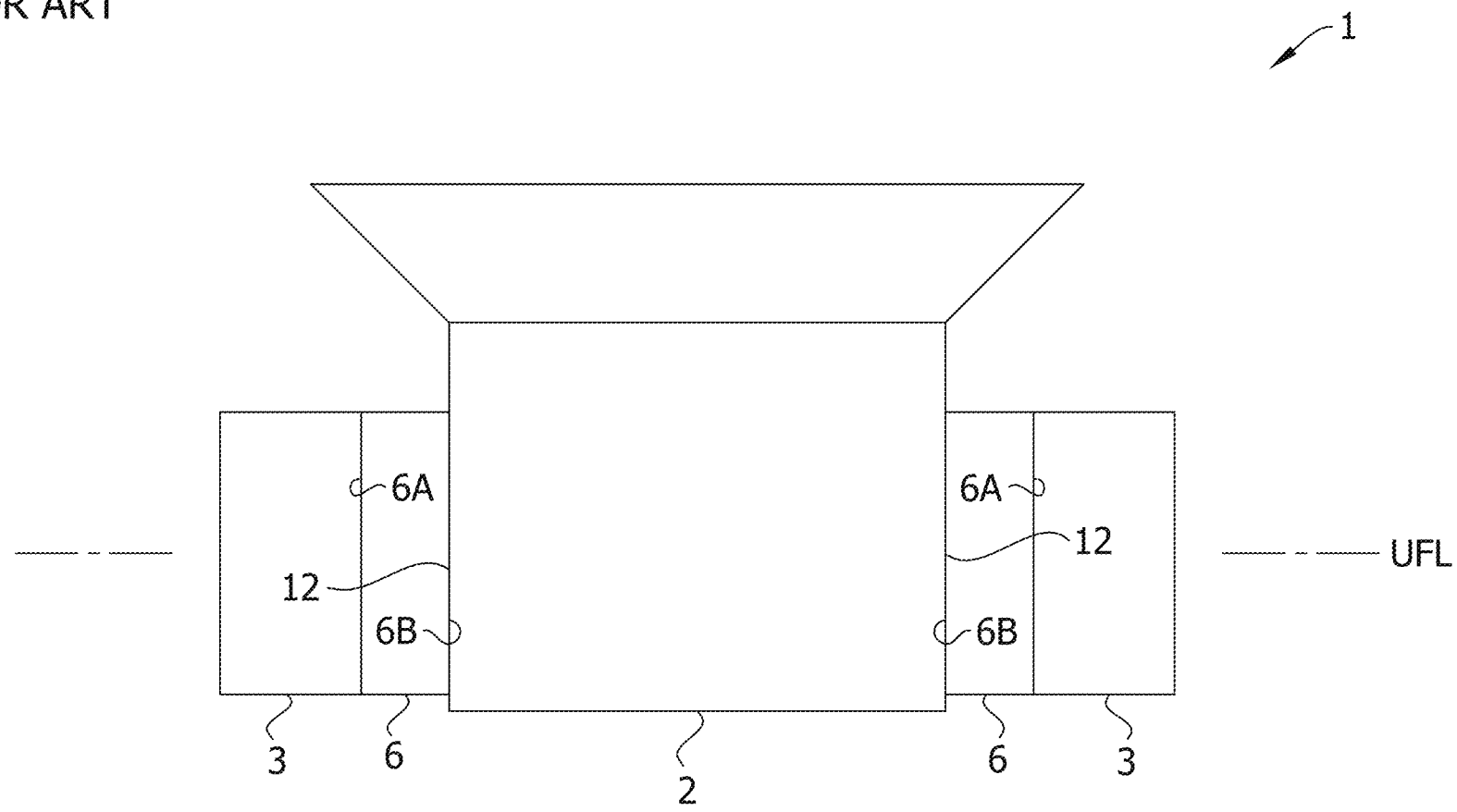
FIG. 1 PRIOR ART
FIG. 1 is a schematic elevation of a prior art carburetor in an upright orientation.

Referring now to the drawings and in particular to FIG. 1, a carburetor is illustrated schematically and is generally indicated at 1. The illustrated carburetor is a four barrel carburetor of the type used on a vehicle, but can be any type of carburetor used for any type of gasoline engine. The carburetor includes a main body 2 and first and second fuel bowls 3 from which fuel is drawn to mix with air for feeding into an engine (not shown). Each of the fuel bowls 3 is mounted on the main body 2 of the carburetor 1 by a respective meter block 6. Each meter block 6 includes a fuel bowl face 6A that forms a wall of the fuel bowl and an opposite main body face 6B that engages a respective side wall portion 12 of the main body 2 at a sealed interface. In FIG. 1, the carburetor is shown in an upright orientation. Throughout this disclosure, terminology describing the vertical orientation or positioning of the features of the carburetor 1 will be understood to refer to the carburetor or components of the carburetor in the upright position as shown in FIG. 1. Thus, the upright orientation shown in FIG. 1 provides the frame of reference for terms such as "top," "bottom," "upper," "lower," "upward," and "downward" throughout this disclosure. In the upright orientation, a float assembly (not shown) maintains the level of fuel in the respective fuel bowl 3 at an upright fuel level UFL. At the upright fuel level UFL, the fuel bowl face 6A of each meter block is only partially immersed in fuel.

As is known in the art, various passages (not shown) extend through each meter block 6 to fluidly connect the interior of each fuel bowl 3 to atmosphere and the main body of the carburetor. For example, in certain conventional meter blocks, one or more fuel discharge passages, one or more air bleed passages, and/or one or more fuel bowl vent passages may extend through the meter block to fluidly communicate between the interior of the fuel bowl and atmosphere and/or the interior of the main body 2 of the carburetor (e.g., a barrel of the carburetor). Some of these passages typically extend from an opening formed in the fuel bowl face 6A of the meter block 6 to an opening formed in the main body face 6B of the meter block. The openings formed in the fuel bowl face 6A may be located above or below the upright fuel level UFL, depending on the purpose of the passage. The carburetor 1 must have fluid communication paths to atmosphere to draw in air to mix with the liquid fuel. Moreover the fuel bowls require communication with atmosphere to prevent a vacuum effect. The required paths allow fuel to escape the carburetor in rollover situations (which is understood to mean rotation of the carburetor about a horizontal axis from the upright orientation of at least about 90°). As explained below, the present disclosure relates to a rollover shutoff valve assembly that may be installed in the carburetor 1 to prevent fuel from entering the main body of the carburetor and subsequently escaping the carburetor in the event of a rollover accident.

Figure 2:
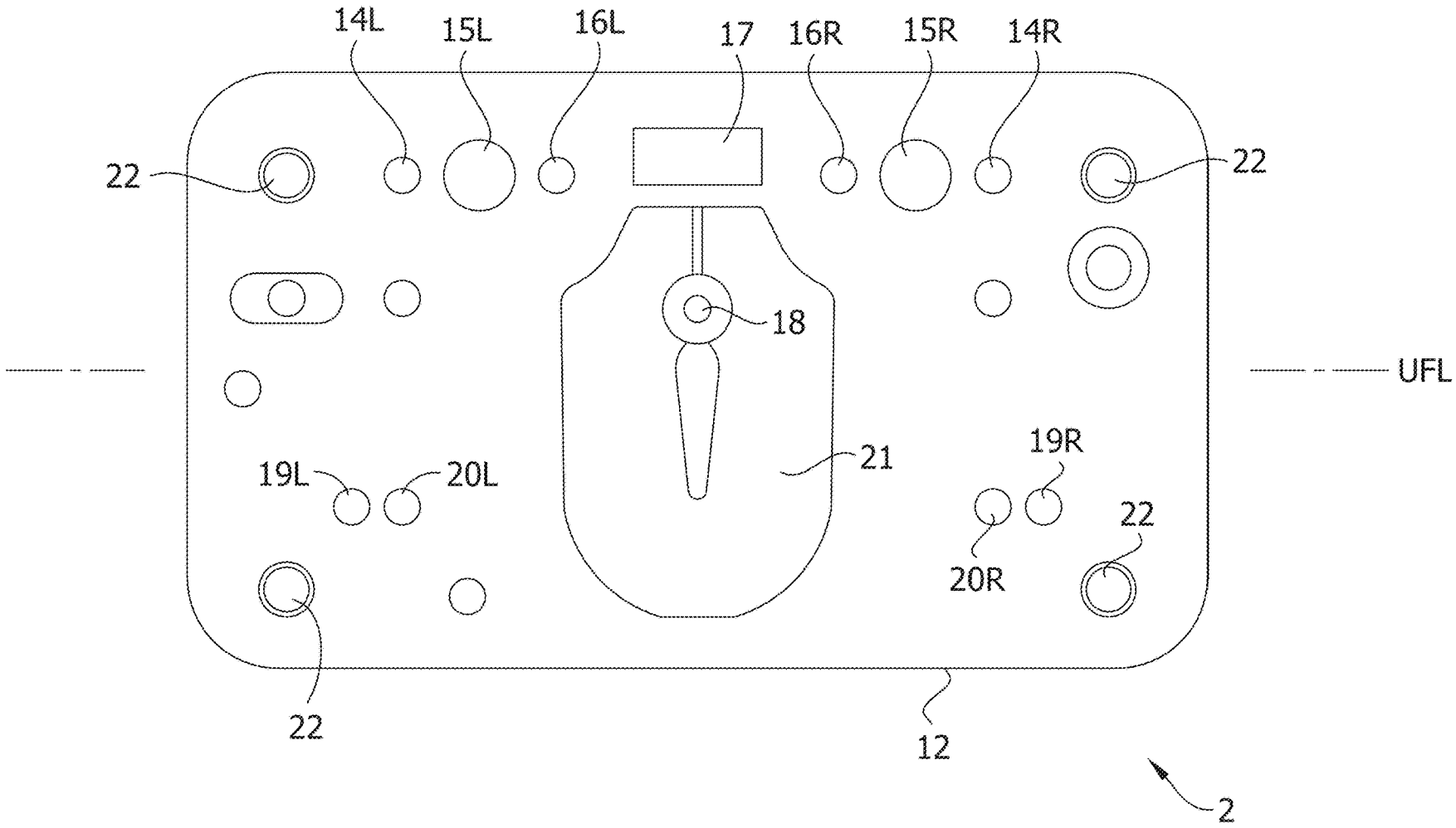
FIG. 2 PRIOR ART
FIG. 2 is an elevation of a side wall portion of a main body of the carburetor that defines an arrangement of ports for communicating with the meter block of the carburetor.

Referring to FIG. 2, in one conventional carburetor, openings formed in the main body surface 6B of each meter block 6 are arranged in register with ports that are formed in a respective side wall portion 12 of the main body 2. In the illustrated embodiment, each side wall portion 12 of the main body 2 includes left and right idle air bleed ports 14L, 14R, left and right main fuel supply ports 15L, 15R, left and right main air bleed ports 16L, 16R, and a bowl vent port 17 that are substantially aligned along a horizontal line located above the upright fuel level UFL. As is understood in the art, these ports are aligned with respective passages extending through the meter block 6, and the meter block passages (not shown) can provide pathways for fuel to leak from the fuel bowl 3 into the main body 2 and out of the carburetor 1 when the carburetor is turned from an upright position, such as in rollover situations. In addition to the aligned ports located above the upright fuel level UFL, the side wall portion 12 of the main body 2 also defines a discharge nozzle port 18, left and right curb-idle discharge ports 19L, 19R, and left and right idle-transfer slot ports 20L, 20R. As is understood in the art, when the carburetor 1 becomes inverted, these ports align with passages extending through the meter block 6 that would not typically be expected to allow liquid fuel to flow into the main body 2. In addition to the ports described above, the side wall portion 12 of the main body 2 defines a manifold vacuum chamber 21 for operatively receiving a portion of a power valve (not shown) of the carburetor 1 therein as is known in the art. In addition to the ports, the side wall portion 12 of the main body 2 defines a plurality of threaded holes 22 for threadably receiving screws (not shown) for mounting the respective fuel bowl 3 and meter block 6 on the main body 2.

Figure 3:
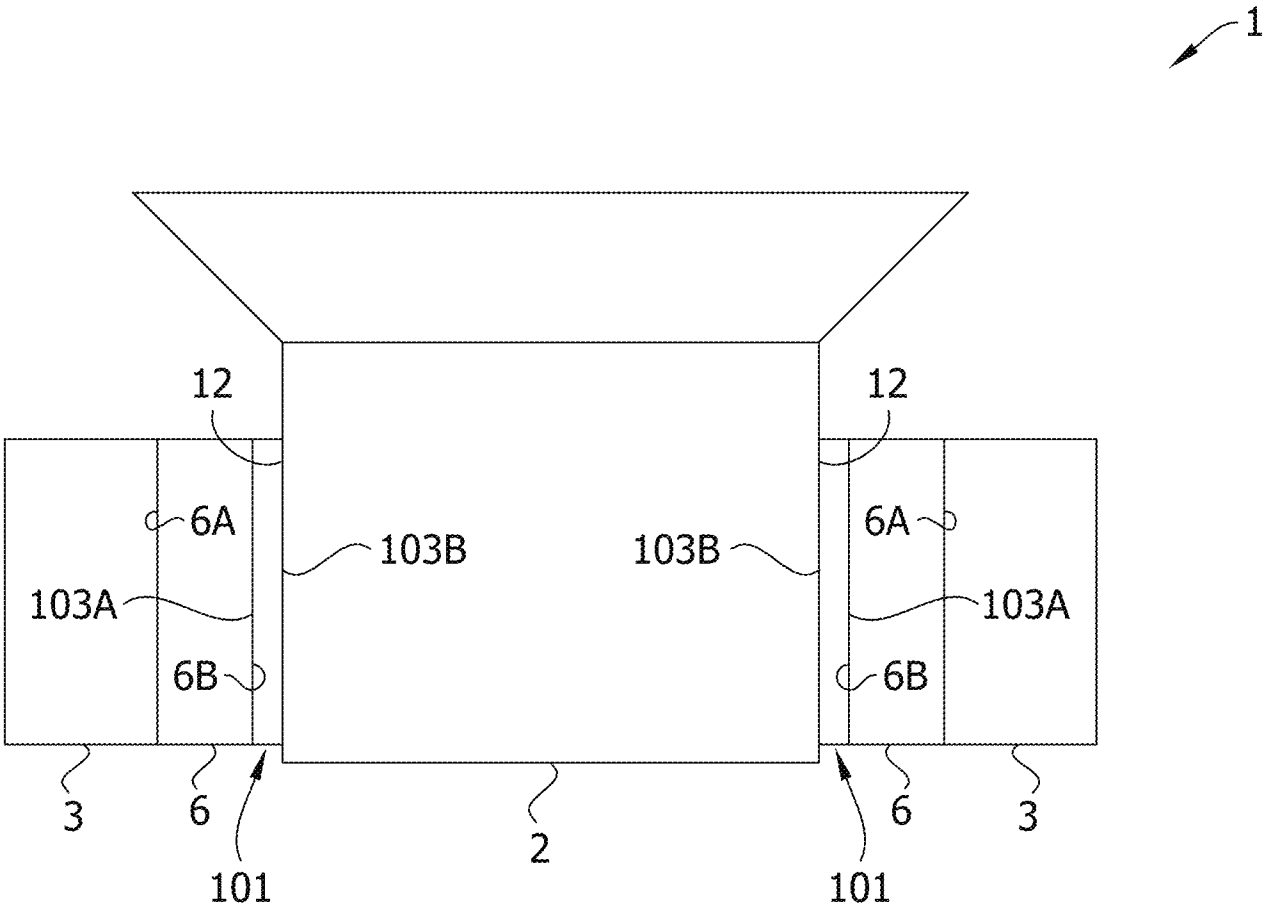
FIG. 3 is a schematic elevation of a carburetor with rollover fuel shutoff valve assemblies installed at the interfaces between the main body and the meter blocks.

Referring to FIG. 3, a rollover shutoff valve assembly, generally indicated at 101, may be installed in the carburetor 1 at each interface between the meter block 6 and the side wall portion 12 of the main body 2, to inhibit fuel spillage in a rollover event. It is understood that the shutoff valve assemblies 101 may be installed as a retrofit installation in an existing carburetor or be installed by a carburetor manufacturer as an original component in a carburetor assembly. Other configurations are envisioned. For example, the shutoff valve assembly may be part of the meter block or the main body of the carburetor. As shown in FIGS. 4-7, each shutoff valve assembly 101 includes a valve body 103 that defines four mounting holes 104 that are shaped and arranged for being positioned in register with the threaded holes 22 of the side wall portion 12 of the main body 2. Thus, each valve assembly 101 may be mounted on the main body 2 along with the meter block 6 using screws (not shown) that extend through the mounting holes 104 and are threadably received in the threaded holes 22. To permit a retrofit of the shutoff valve assembly 101 in an existing carburetor, longer screws (not shown) may be provided in a kit with the shutoff valve assembly 101.

Figure 4:
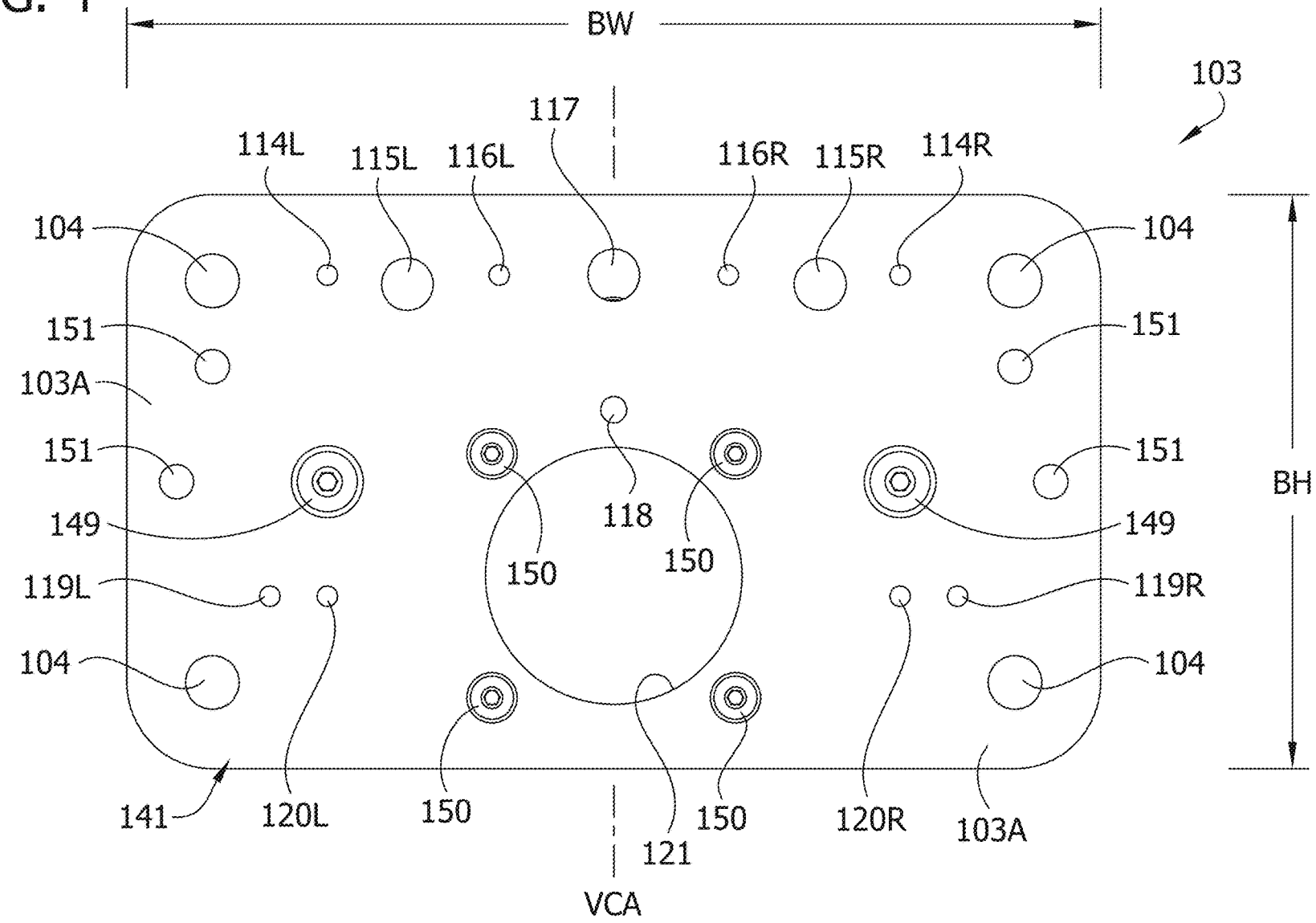
FIG. 4 is a side elevation of one of the shutoff valve assemblies in an upright orientation.
Figure 6:
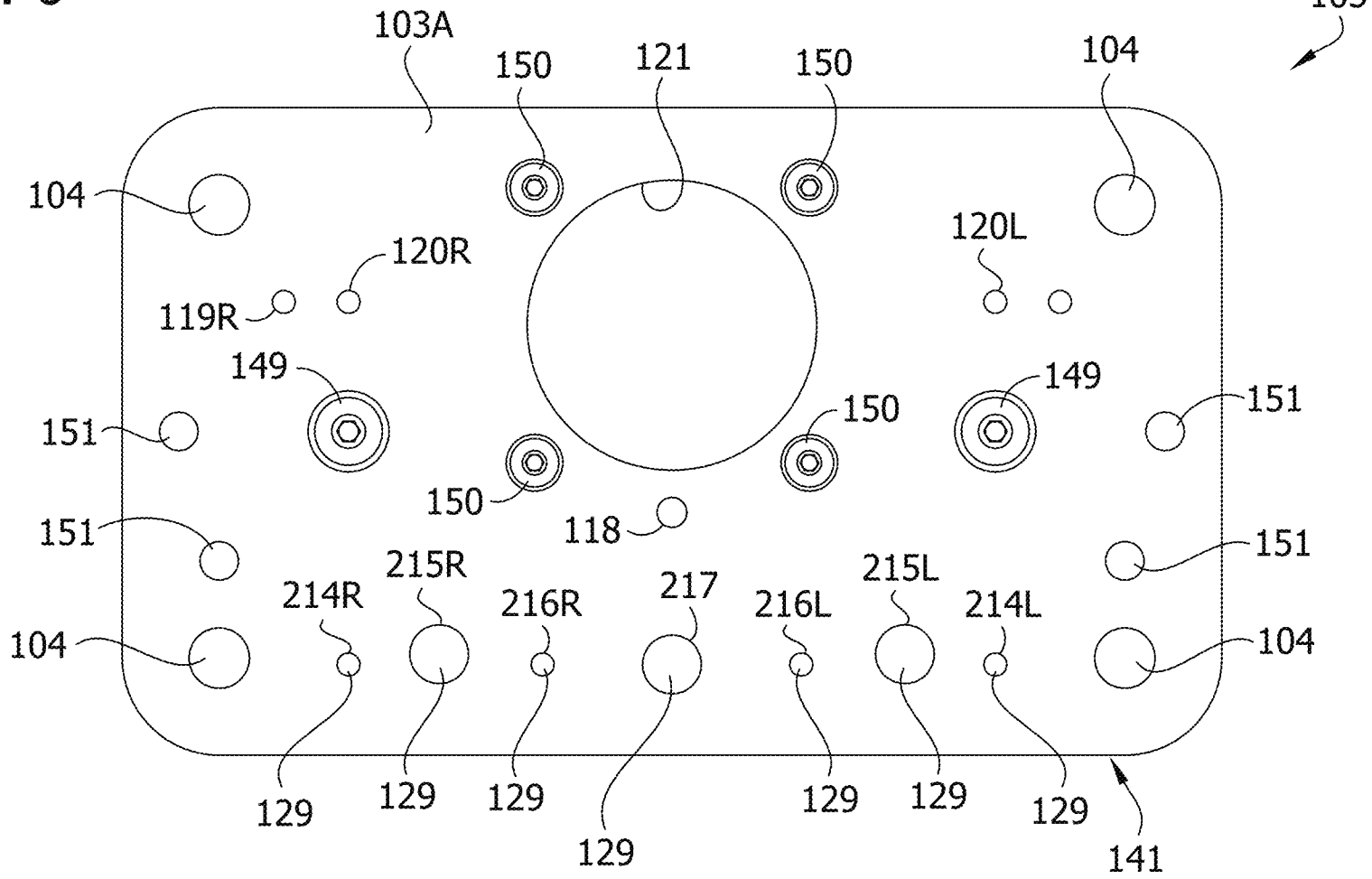
FIG. 6 is the elevation of FIG. 4 but with the shutoff valve assembly in the inverted orientation.
Figure 7:
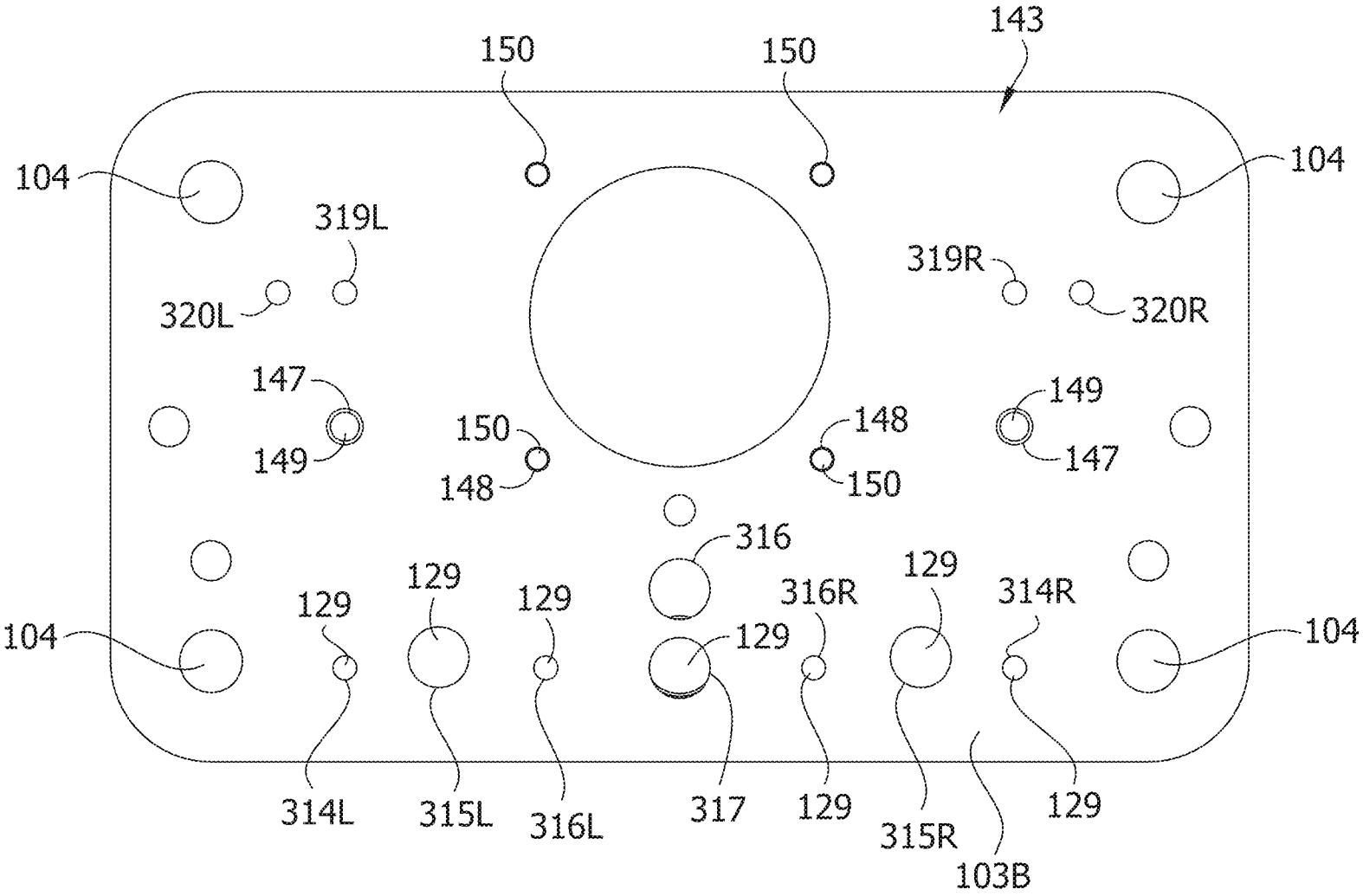
FIG. 7 is the elevation of FIG. 5 of the shutoff valve assembly in the inverted orientation.
Figure 8:
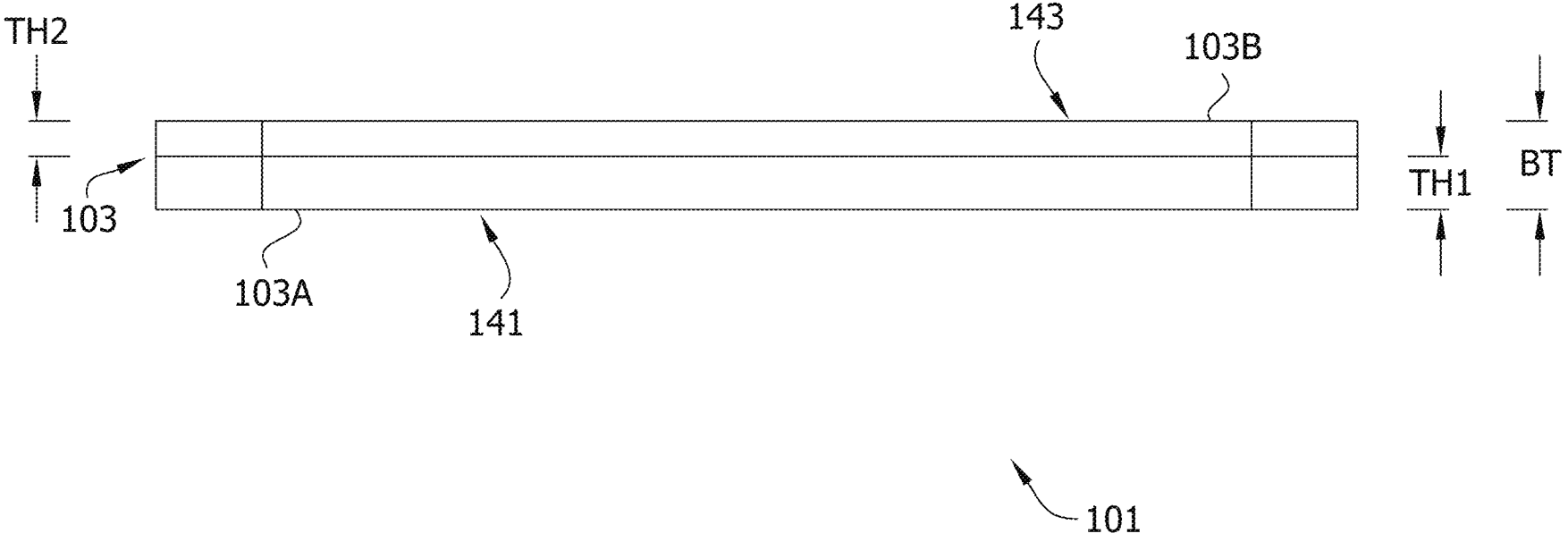
FIG. 8 is a top plan view of the shutoff valve assembly.

Referring to FIGS. 4-10, each shutoff valve assembly 101 includes a valve body 103 that has a top end portion and a bottom end portion spaced apart along a height BH of the body extending along a vertical center axis VCA (FIG. 4). The valve body 103 further includes a meter block face 103A (FIGS. 4 and 6) and a main body face 103B (FIGS. 5 and 7) that are spaced apart along a thickness BT of the body (FIG. 8). The valve body 103 also has a right side portion and a left side portion disposed on opposite sides of the vertical center axis VCA and spaced apart along a width BW of the body (FIG. 4). In the illustrated embodiment, various features of the shutoff valve assembly 101 are mirrored on each side of the vertical center axis VCA. Mirrored features of the shutoff valve assembly 101 shown on the right side of the vertical center axis VCA as shown in FIG. 4 are indicated with a reference number ending in the letter R; mirrored features shown on the left side of the vertical center axis as shown in FIG. 4 are indicated with a reference number ending in the letter L. It is understood that the terms left and right are used in this disclosure in reference to the appearance of the shutoff valve assembly 101 as shown in FIG. 4, and the orientation of the shutoff valve assembly, and thus the features thereof, will vary in use.

The valve body 103 defines a plurality of passages extending through the thickness BT of the body that are shaped and arranged to communicate between the ports 14L, 14R, 15L, 15R, 16L, 16R, 17 in the side wall 12 of the main body 2 and the corresponding openings (not shown) in the main body face 6B of the meter block 6. In the illustrated embodiment, the valve body 103 defines left and right idle air bleed passages 114L, 114R, left and right main fuel supply passages 115L, 115R, left and right main air bleed passages 116L, 116R, and a bowl vent passage 117. When the shutoff valve assembly 101 is mounted in the carburetor, the passages 114L, 114R, 115L, 115R, 116L, 116R, 117 are substantially aligned along a horizontal line located above the upright fuel level UFL in registration with the respective ports 14L, 14R, 15L, 15R, 16L, 16R, 17 to convey air between the meter block 6 and the main body 2 of the carburetor 1. The shutoff valve assembly 101 is configured to automatically close the passages 114L, 114R, 115L, 115R, 116L, 116R, 117 when the carburetor becomes inverted as in a rollover situation. As explained in further detail below, the valve body 103 defines races that are aligned along the width BW of the shutoff valve body with the passages 114L, 114R, 115L, 115R, 116L, 116R, 117 and that are each configured to guide movement of a respective plug 129 to a position in which the plug blocks the respective passage when the carburetor 1 becomes inverted (FIGS. 6 and 7).

In addition to the passages 114L, 114R, 115L, 115R, 116L, 116R, 117, the shutoff valve assembly also defines a discharge nozzle passage 118, left and right curb-idle discharge passages 119L, 119R, and left and right idle-transfer slot passages 120L, 120R that are respectively shaped and arranged to provide fluid communication across the thickness BT of the shutoff valve assembly body 103 between the main body ports 18, 19L, 19R, 20L, 20R and the respective openings (not shown) in the main body face 6B of the meter block 6. It will be understood that a valve body may define other arrangements of passages that are shaped and positioned to operatively communicate between the ports in a carburetor main body and the corresponding openings in a meter block. The shutoff valve assembly body 103 also defines a power valve hole 121 that allows the body of a power valve (not shown) to pass through the shutoff valve assembly 101 and be operatively received in the manifold vacuum chamber 21 of the main body 12.

Figure 5:
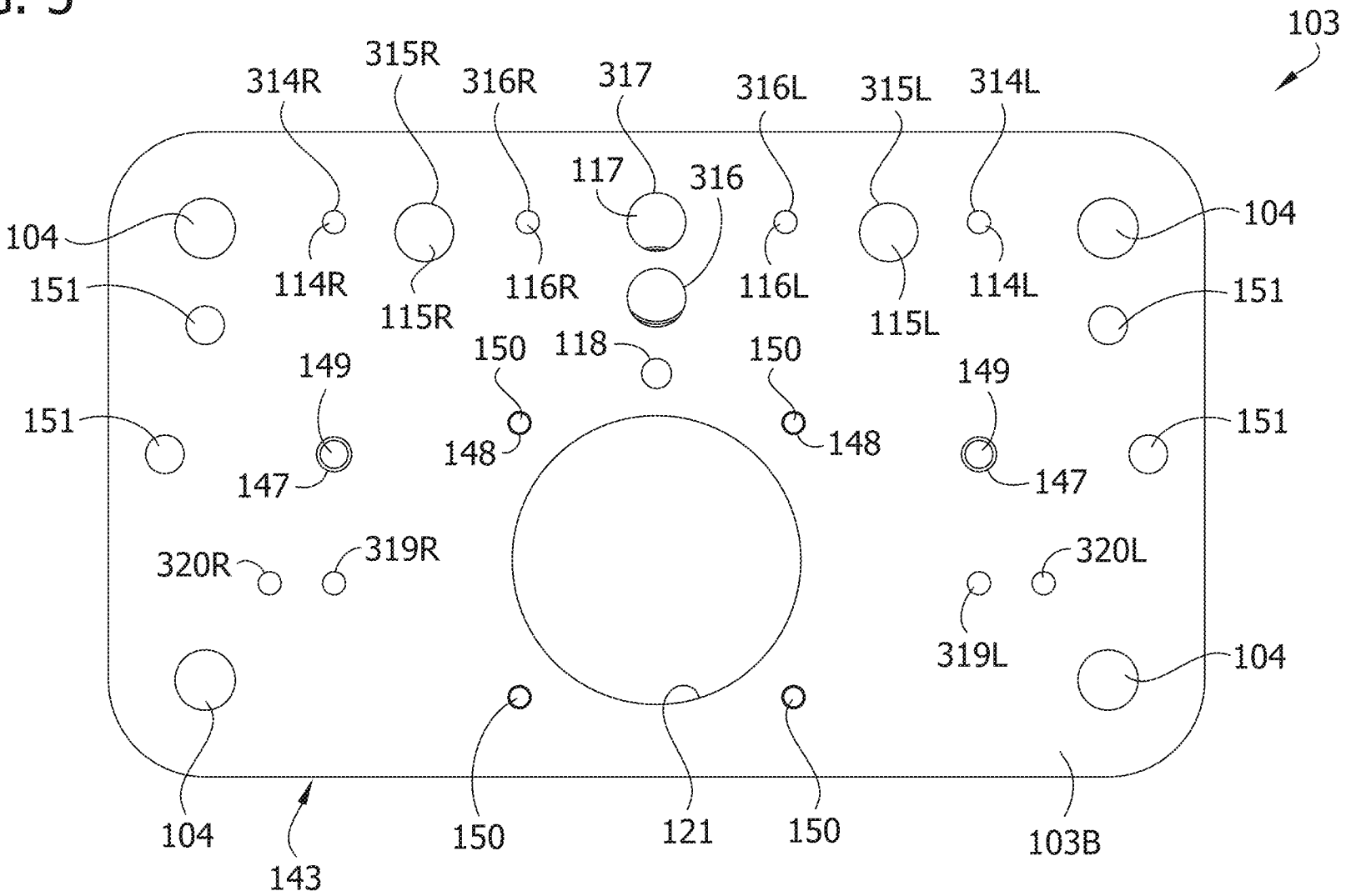
FIG. 5 is an elevation similar to FIG. 4 of the opposite side elevation of the shutoff valve assembly.
Figure 11:
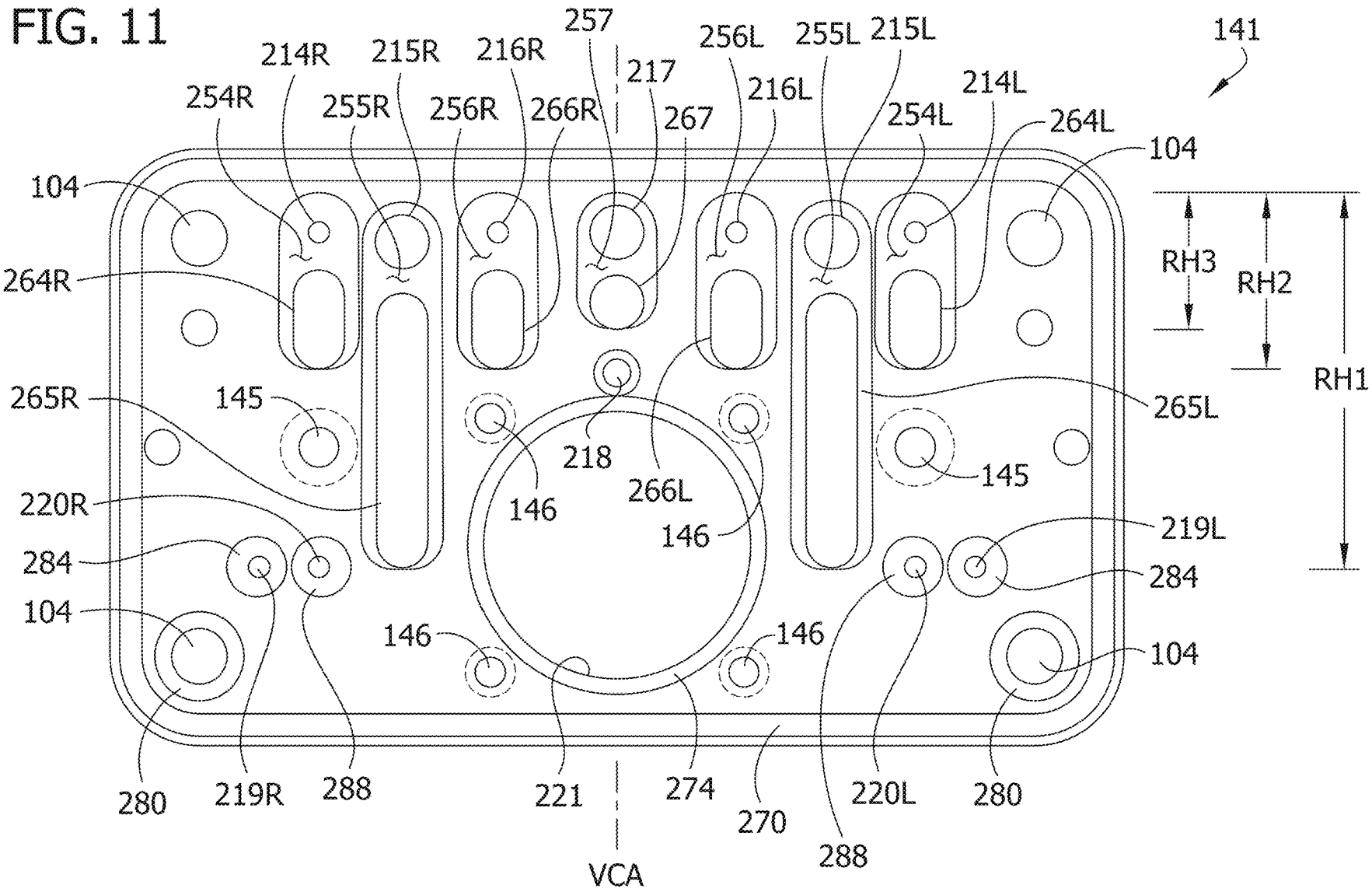
FIG. 11 is an interior elevation of the first housing member of the shutoff valve assembly.
Figure 13:
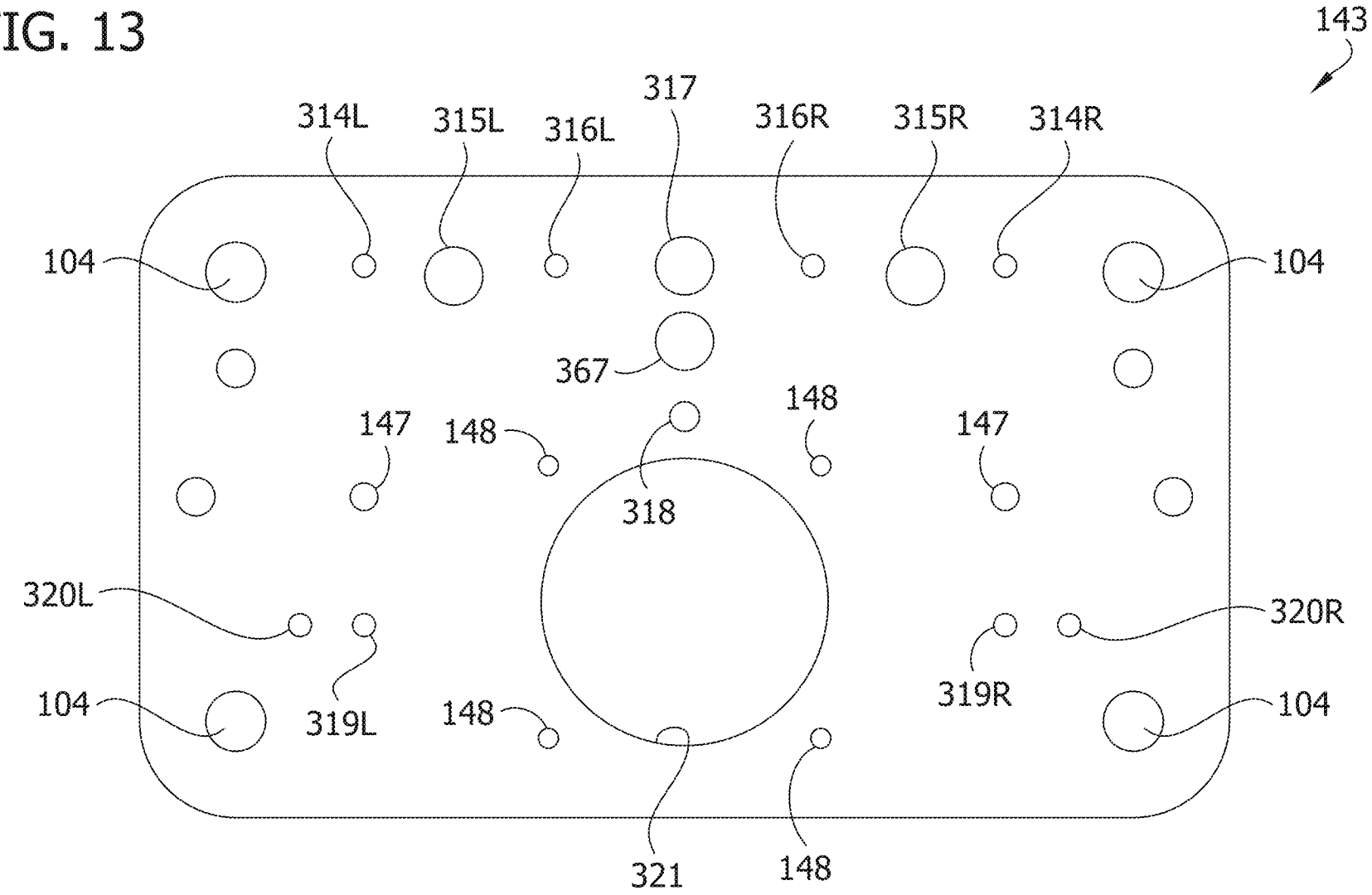
FIG. 13 is an interior elevation of a second housing member of the shutoff valve assembly.

As shown in FIG. 8, the valve body 103 comprises first and second housing members 141, 143 that are secured together to form the shutoff valve body. In one or more embodiments, the first and second housing members 141, 143 are formed from a metal such as aluminum, but other materials may also be used without departing from the scope of the invention. The first housing member 141 includes the meter block face 103A of the valve body 103, and the second housing member 143 includes the main body face 103B of the shutoff valve body. Each of the housing members 141, 143 has about the same height and width such that when the housing members are secured together, the valve body 103 has a substantially smooth and continuous perimeter edge margin. As shown in FIG. 11, the first housing member 141 defines a first pair mounting holes 145 and a first group of four mounting holes 146. As shown in FIG. 13 the second housing member 143 defines a second pair of mounting holes 147 that are shaped and arranged to align with the first pair of mounting holes 145 of the first housing member 141, and further defines a second group of four mounting holes 148 shaped and arranged to align with the first group of four mounting holes 146 of the first housing member. The groups of four mounting holes 146, 148 in the first and second housing members 141, 143 are arranged around the power valve hole 121. In the illustrated embodiment, the mounting holes 145, 146,147, 148 are threaded, and the mounting holes 145, 146 formed in the first housing member 141 are countersunk. Screws 149 thread through the aligned first and second pairs of mounting holes 145, 146. Screws 150 thread through the aligned first and second groups of mounting holes 147, 148. The first pair of mounting holes 145 and first group of mounting holes 146 are countersunk on the exterior face of the first housing member 141. Because the mounting holes 145, 146 are countersunk, the heads of the screws 149, 150 are recessed below the meter block surface 103A of the valve body 103 so as not to interfere with the meter block 6 when the shutoff valve assembly 101 is installed in the carburetor 101. Referring to FIGS. 4 and 5, dowel holes 151 are formed in the first and second housing members 141 to receive alignment dowels (not shown) of the meter block 6 when the shutoff valve assembly 101 is installed in the carburetor.

Figure 12:
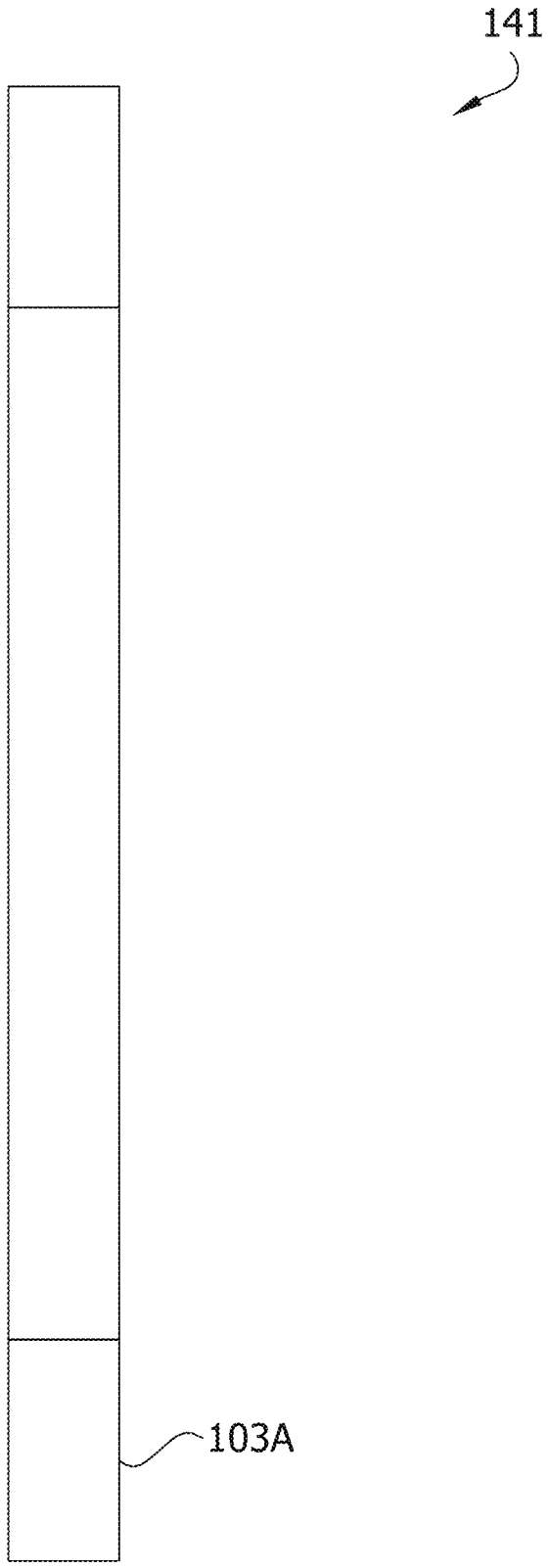
FIG. 12 is an enlarged, left end elevation of the first housing member of FIG. 9.

Referring to FIGS. 4 and 6, the first housing member 141 has an outer surface that forms the meter block face 103A of the valve body 103, an inner surface for opposingly engaging second housing member 143, and a thickness TH1 extending from the outer surface to the inner surface. It is understood that in other embodiments the first housing member could form the main body face of the body instead of the meter block face. As shown in FIGS. 11-13, the first housing member 141 defines a plurality of holes extending through the thickness TH1 that are shaped and arranged to form portions of the shutoff valve passages 114L, 114R, 115L, 115R, 116L, 116R, 117, 118, 119L, 119R, 120L, 120R, 121. Specifically, the first housing member 141 defines left and right idle air bleed holes 214L, 214R, left and right main fuel supply holes 215L, 215R, left and right main air bleed holes 216L, 216R, a bowl vent hole 217, a discharge nozzle hole 218, left and right curb-idle discharge holes 219L, 219R, left and right idle-transfer slot holes 220L, 220R, and a power valve hole 221 that form portions of the respective passages 114L, 114R, 115L, 115R, 116L, 116R, 117, 118, 119L, 119R, 120L, 120R, 121. In the illustrated embodiment, each of the holes has a circular shape, but other embodiments can include holes having other shapes without departing from the scope of the invention.

Referring to FIGS. 11 and 12, the first housing member 141 defines a plurality of elongate primary grooves 254L, 254R, 255L, 255R, 256L, 256R, 257 that are spaced apart along the width BW of the valve body 103 in substantial alignment with the holes 214L, 214R, 215L, 215R, 216L, 216R, 217. Specifically, the illustrated housing member 141 defines left and right idle air bleed primary grooves 254L, 254R that are aligned with the left and right idle air bleed holes 214L, 214R, left and right main fuel supply primary grooves 255L, 255R that are aligned with the left and right main fuel supply holes 215L, 215R, left and right main air bleed primary grooves 256L, 256R that are aligned with the left and right main air bleed holes 216L, 216R, and a bowl vent primary groove 257 that is aligned with the bowl vent hole 217. As explained in further detail below, each of the primary grooves 254L, 254R, 255L, 255R, 256L, 256R, 257 forms a portion of a respective race that guides movement of the respective plug 129 to close one of the passages 114L, 114R, 115L, 115R, 116L, 116R, 117 when the shutoff valve assembly 101 becomes inverted.

Each primary groove 254L, 254R, 255L, 255R, 256L, 256R, 257 is formed in the inner surface of the first housing member 141. Each primary groove 254L, 254R, 255L, 255R, 256L, 256R, 257 has a groove depth extending along the thickness TH1 of the first housing member 141 from the inner surface of the first housing member. In one or more embodiments, the groove depth is greater than about one-half of the thickness TH1 of the first housing member 141 but less than the entire thickness of the first housing member. In the illustrated embodiment, the groove depth is substantially constant along the respective race. But in other embodiments the depth of the primary groove may vary without departing from the scope of the invention. As will be explained in further detail below, in the illustrated embodiment each primary groove 254L, 254R, 255L, 255R, 256L, 256R, 257 defines the entire depth of the respective race. Thus, the primary groove depth is equal to the race depth in the illustrated embodiment.

Each primary groove 254L, 254R, 255L, 255R, 256L, 256R, 257 extends from a bottom end portion to a top end portion along a height that defines the height RH1, RH2, RH3 of the respective one of the races. Each hole 214L, 214R, 215L, 215R, 216L, 216R, 217 is located along the height RH1, RH2, RH3 of the respective race adjacent the top end portion of the respective primary groove 254L, 254R, 255L, 255R, 256L, 256R, 257. In the illustrated embodiment, the main fuel supply races formed by primary grooves 255L, 255R have the first race height RH1, the air bleed races formed by primary grooves 254L, 256L, 254R, 256R have the second race height RH2, and the bowl vent race formed by primary groove 257 has the third race height RH3. The first race height RH1 is taller than the second race height RH2, and the second race height is taller than the third race height RH3. The short third race height RH3 prevents the bowl vent primary groove 257 from intersecting the discharge nozzle hole 218, which is located directly below the bowl vent hole 217 along the vertical center axis VCA. As explained in further detail below, the difference between the first race height RH1 of main fuel supply races and the shorter second height RH2 of the air bleed races accounts for the differences in pressures at the main fuel supply passages 115L, 115R and the air bleed passages 114L, 114R, 116L, 116R during use of the carburetor 1.

The primary grooves 254L, 254R, 255L, 255R, 256L, 256R, 257 each have a groove width extending between the left side portion and the right side portion of the primary groove. As explained below, the width of each primary groove defines the width of the respective race; thus the primary groove width is equal the race width in the illustrated embodiment. In the illustrated embodiment, the width of each primary groove 254L, 254R, 255L, 255R, 256L, 256R, 257 varies along the height RH1, RH2, RH3 of each race. More specifically, the width of each primary groove 254L, 254R, 255L, 255R, 256L, 256R, 257 is widest at the top end portion of the primary groove and tapers inward as it extends downward such that the primary groove is narrowest at the bottom end portion of the primary groove. For example, in the illustrated embodiment, each of the left and rights side portions of each primary groove 254L, 254R, 255L, 255R, 256L, 256R, 257 is slightly skewed with respect to the vertical center axis VCA. The left and right side portions extend inward toward one another as they extend from the top end portion to the bottom end portion of the primary groove 254L, 254R, 255L, 255R, 256L, 256R, 257. As explained in further detail below, the slightly sloped sides of the primary grooves 254L, 254R, 255L, 255R, 256L, 256R, 257 ensure that the shutoff valve assembly 101 functions to close the passages 114L, 114R, 115L, 115R, 116L, 116R, 117, even when the carburetor 1 is only rotated by about 90° about a horizontal axis from the upright orientation (e.g., in a collision that causes a vehicle to roll over onto its side).

Figure 9:
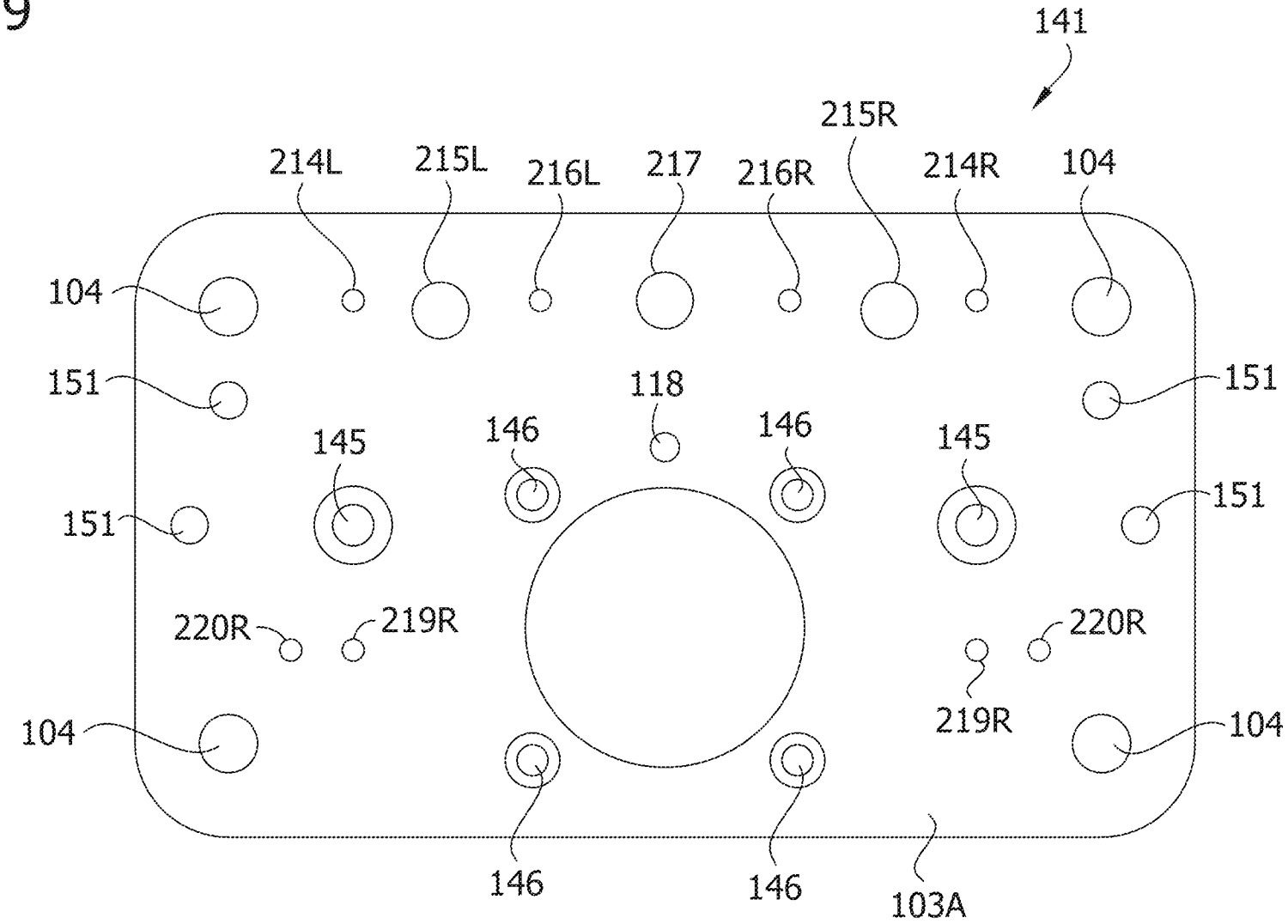
FIG. 9 is an elevation of a first housing member of the shutoff valve assembly.
Figure 10:
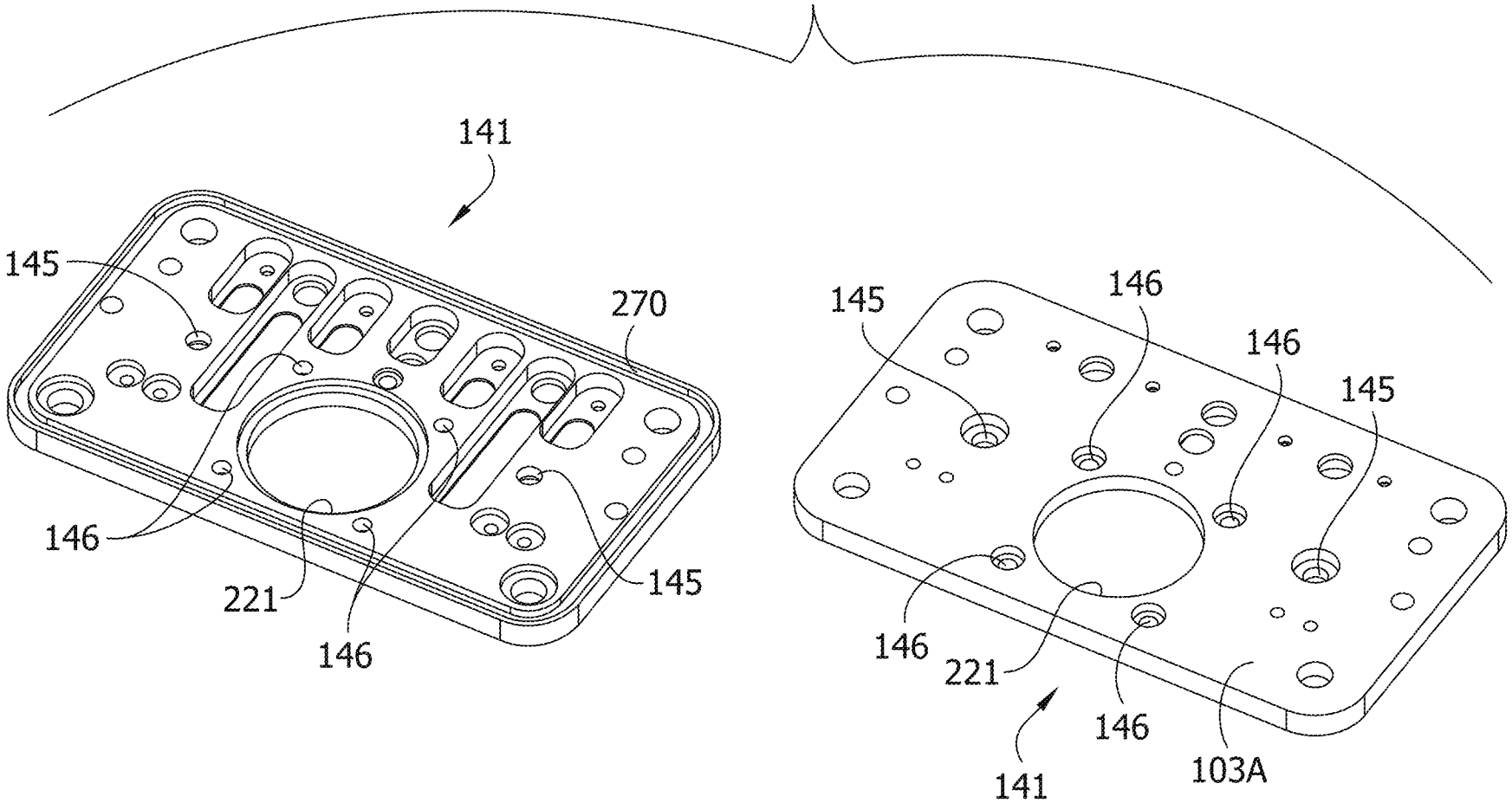
FIG. 10 is a perspective of the first housing member of the shutoff valve assembly, showing an interior and exterior view of the first housing member side-by-side.

As shown in FIGS. 9 and 11, a secondary groove 264L, 264R, 265L, 265R, 266L, 266R, 267 (broadly, a "recess") extends from the bottom of the respective primary groove 254L, 254R, 255L, 255R, 256L, 256R, 257, further into, but not through the first housing member 141 along a portion of the height RH1, RH2 of the races. Each secondary groove 264L, 264R, 265L, 265R, 266L, 266R, 267 has a length that extends from a bottom end that is spaced apart above the bottom end of the respective primary groove 254L, 254R, 255L, 255R, 256L, 256R, 257 to a top end that spaced apart below the top end of the respective primary groove and from the bottom end of the respective hole 214L, 214R, 215L, 215R, 216L, 216R, 217. In the case of secondary groove 267, its shape is circular in the illustrated embodiment. Each secondary groove 264L, 264R, 265L, 265R, 266L, 266R, 267 has a width that is slightly narrower than the width the respective primary groove 254L, 254R, 255L, 255R, 256L, 256R, 257. Likewise, the diameter of each of the holes 214L, 214R, 215L, 215R, 216L, 216R, 217 is narrower than the width of the respective primary groove 254L, 254R, 255L, 255R, 256L, 256R, 257. As explained in further detail below, the secondary grooves 264L, 264R, 265L, 265R, 266L, 266R, 267 remove material from the bottom of each primary groove 254L, 254R, 255L, 255R, 256L, 256R, 257 to reduce contact area between the plug 129 and valve body and therefore reduce frictional resistance to closing the shutoff valve assembly 101. Similar secondary grooves (not shown) could be provided in the interior face of the second housing member 143 to further reduce frictional resistance to movement of the plug 129 with respect to the valve body 103.

Figure 17:
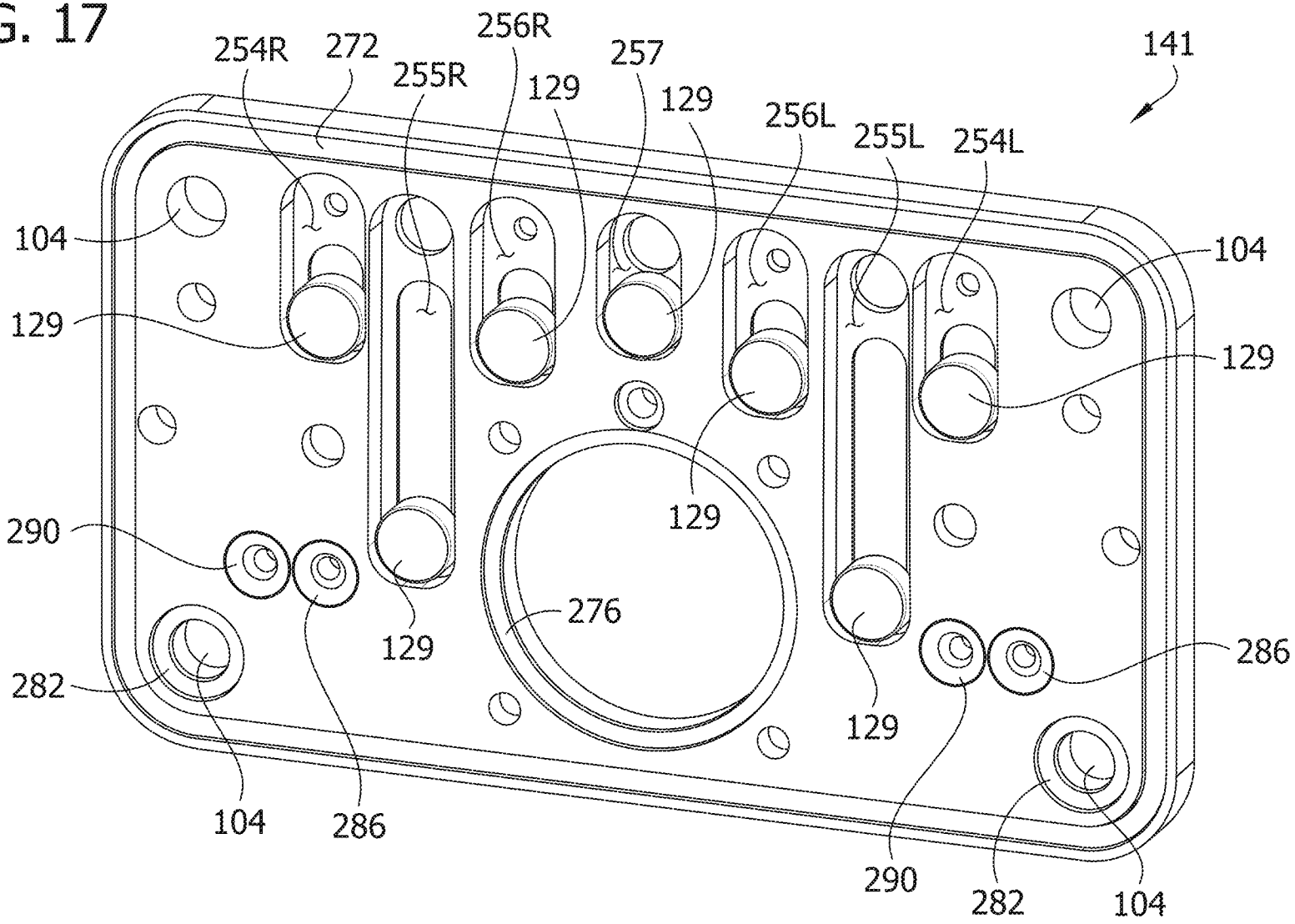
FIG. 17 is a photograph similar to FIG. 5 with the second housing member removed to illustrate the positions of the plugs in the upright orientation.

A perimeter channel 270 is formed in the interior face of the first housing member 141. The perimeter channel 270 (FIG. 11) can receive a portion of a gasket 272 (FIG. 17) that extends continuously around the perimeter of the first housing member 141. When assembled with the second housing member 143, the gasket is compressed between the first and second housing members 141,143 to seal the interior of the shutoff valve assembly 101. Similarly, a channel 274 (FIG. 11) is formed in the interior face of the first housing member 141 around the power valve hole 221. The channel 274 may receive an O-ring 276 (FIG. 17) that is compressed between the first and second housing members 141, 143 when assembled. The O-ring 276 seals, in essence, an inner periphery of the shutoff valve assembly. Thus, any migration of fuel between the various holes and races in the shutoff valve assembly is completely contained within the shutoff valve assembly between the O-rings 272 and 276. In addition, channels 280 (FIG. 11) formed around two of the mounting holes 104 on the interior face of the first housing member receive O-rings 282 (FIG. 17). In normal operation, these two O-rings 282 are around only the mounting holes 104 that are the bottom of the shutoff valve assembly 101. In that position fuel flows more readily through the shutoff valve assembly and these O-rings 282 inhibit leakage. However, it will be understood that O-rings (not shown) could be added around all of the mounting holes 104 within the scope of the present invention. Channels 284 (FIG. 11) around left and right curb-idle discharge holes 219L, 219R, on the interior face of the first housing member 141 receive O-rings 286 (FIG. 17). Similarly, channels 288 (FIG. 11) around left and right idle-transfer slot holes 220L, 220R have O-rings 290 (FIG. 17). The curb-idle discharge ports 19L, 19R and idle-transfer slot ports 20L, 20R (formed in part by the holes 219L, 219R, 220L, 220R) also normally are on a lower part of the shutoff valve assembly 101 and the O-rings 286, 290 inhibit leakage of fuel from the shutoff valve assembly.

Figure 14:
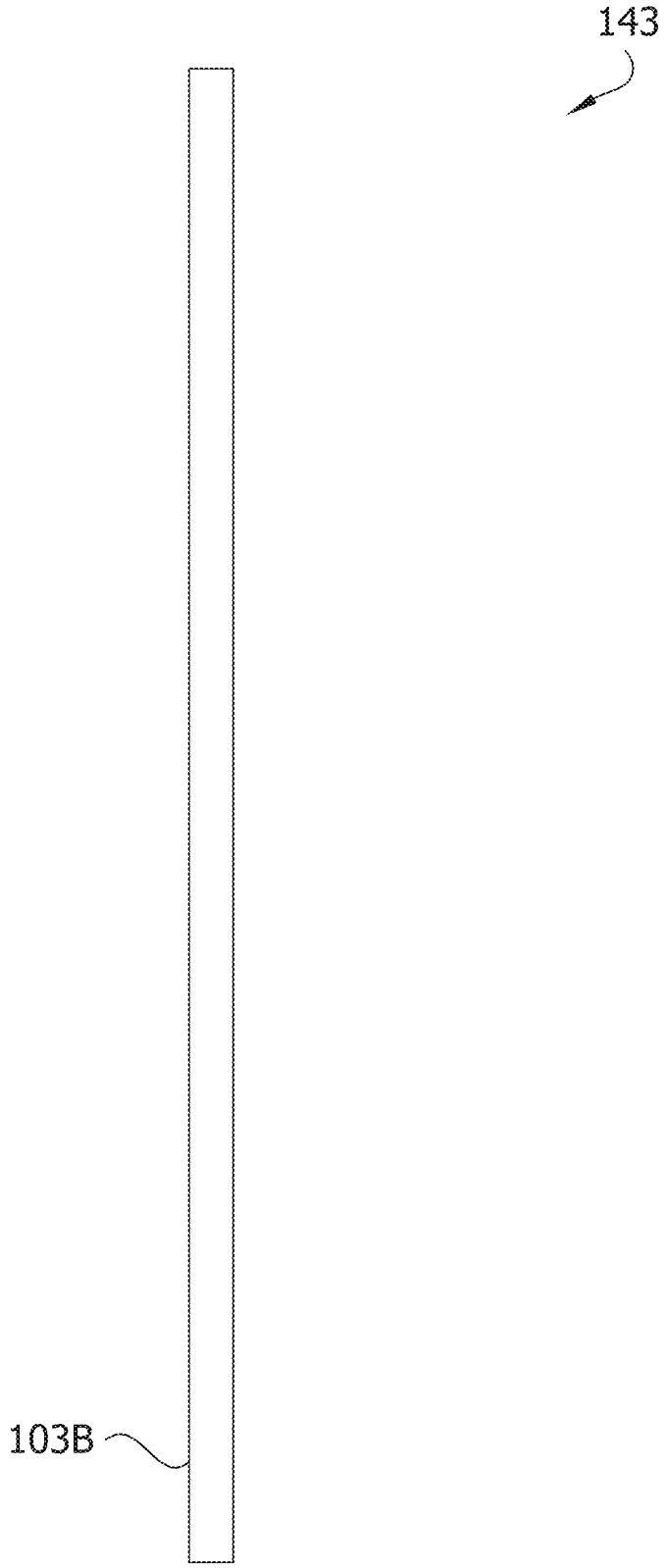
FIG. 14 is an enlarged, left end elevation of the second housing member.
Figure 15:
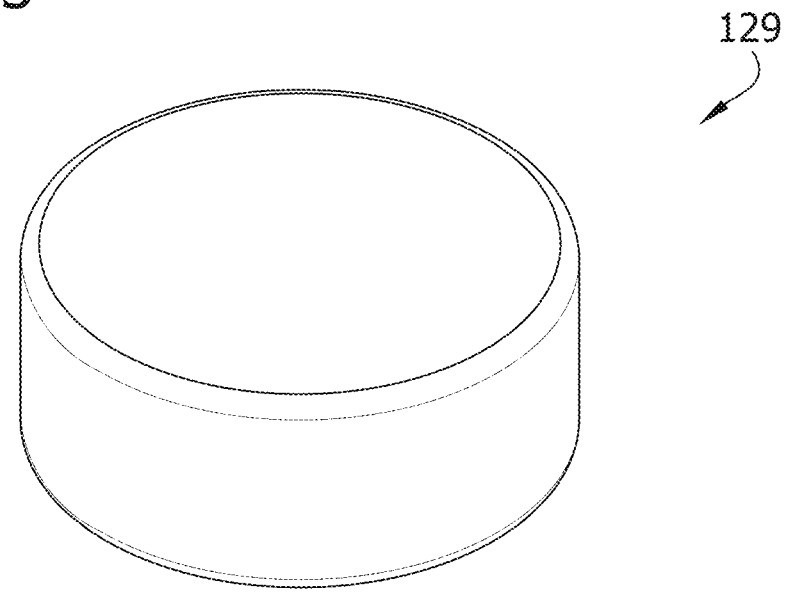
FIG. 15 is a perspective of a plug of the shutoff valve assembly.
Figure 16:
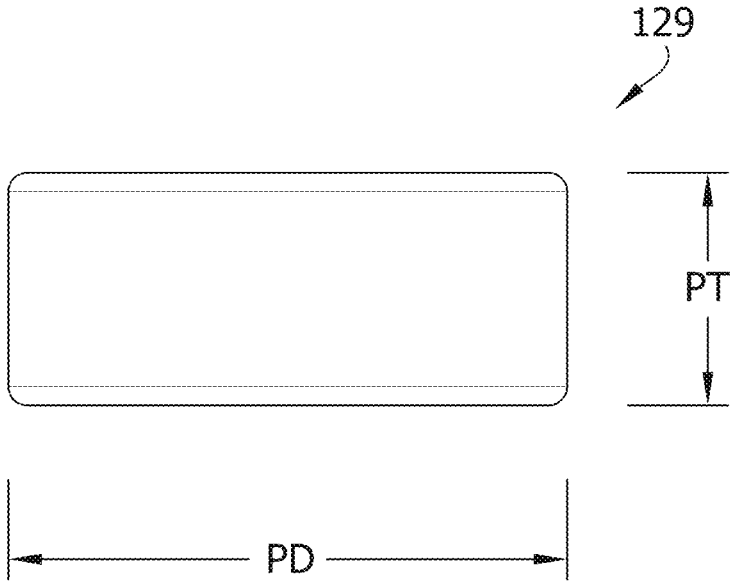
FIG. 16 is an elevation of the plug.

Referring to FIGS. 13 and 14, the second housing member 143 has an outer surface that forms the main body face 1036 of the shutoff valve body 103, an inner surface configured to opposingly engage the inner surface of the first housing member 141, and a thickness TH2 extending from the outer surface to the inner surface. The second housing member 143 defines a plurality of holes extending through the thickness TH2 that are shaped and arranged to form portions of the shutoff valve passages 114L, 114R, 115L, 115R, 116L, 116R, 117, 118, 119L, 119R, 120L, 120R, 121. Specifically, the second housing member 143 defines left and right idle air bleed holes 314L, 314R, left and right main fuel supply holes 315L, 315R, left and right main air bleed holes 316L, 316R, a bowl vent hole 317, a discharge nozzle hole 318, left and right curb-idle discharge holes 319L, 319R, left and right idle-transfer slot holes 320L, 320R, and a power valve hole 321 that form portions of the respective passages 114L, 114R, 115L, 115R, 116L, 116R, 117, 118, 119L, 119R, 120L, 120R, 121. In the illustrated embodiment, each of the holes has a circular shape, but other embodiments can include holes having other shapes without departing from the scope of the invention. The second housing member 143 is constructed to close off the primary grooves 254L, 255L, 256L, 254R, 255R, 256R, 257 to form the races.

Referring to FIGS. 10, 11 and 15-17, the shutoff valve assembly 101 includes a plurality of plugs 129 that are sized and arranged for being movably received in the races. In one or more embodiments, the plugs 129 are formed from a metal such as brass, but other materials may also be used without departing from the scope of the invention. In the illustrated embodiment, each plug 129 has a short, cylindrical shape and comprises a first end and a second end spaced apart from one another along a thickness PT (FIG. 16) of the plug. Suitably, the thickness PT of each plug 129 is slightly smaller than the depth GD of the respective primary groove 254L, 254R, 255L, 255R, 256L, 256R, 257 (and thus the depth of the respective race). In the illustrated embodiment, each primary groove 254L, 254R, 255L, 255R, 256L, 256R, 257 has the same depth GD, so each plug 129 has the same thickness PT. But in other embodiments, the races may have different depths and consequently the plugs may have different thicknesses. Each plug 129 has a circular cross-sectional shape having a plug diameter PD. Suitably, the diameter PD of each plug 129 is slightly smaller than the width of the respective primary groove 254L, 254R, 255L, 255R, 256L, 256R, 257 at the top end portion thereof and larger than the diameters of the passages 114L, 114R, 115L, 115R, 116L, 116R, 117. In other words, each plug 129 is sized and shaped to be movably received in the respective race and to substantially block the respective passage 114L, 114R, 115L, 115R, 116L, 116R, 117. Since the widths of the top end portions of the primary grooves 254L, 254R, 255L, 255R, 256L, 256R, 257 are about the same, the diameters of all of the plugs 129 are likewise about the same. But it will be understood that in other embodiments the diameters of the plugs may vary to correspond with primary grooves having varying widths.

In the shutoff valve assembly 101, one plug 129 is movably received in each race formed by the primary grooves 254L, 255L, 256L, 254R, 255R, 256R, 257 in the first housing member 141 and the opposing interior face of the second housing member 143. The first end of each plug 129 slidably engages the interior wall of the first housing member 141, and the second end of each plug slidably engages the interior wall of the second housing member 143. Thus, the plugs 129 are slidably captured in the races between the first and second housing members 141, 143 to substantially inhibit movement of the plugs in the direction of the thickness BT of the valve body 103. The elongate secondary grooves 264L, 264R, 265L, 265R, 266L, 266R, 267 in the first housing member 141 reduce the size of the contact area between the first and second ends of the plugs 129 and the housing member 141. Similar secondary grooves (not shown) could be formed in the second housing member 143. The reduced contact area reduces the frictional engagement between the plugs 129 and the valve body 103 and thus enhances sliding of the plugs along the heights RH1, RH2, RH3 of the races.

Figure 18:
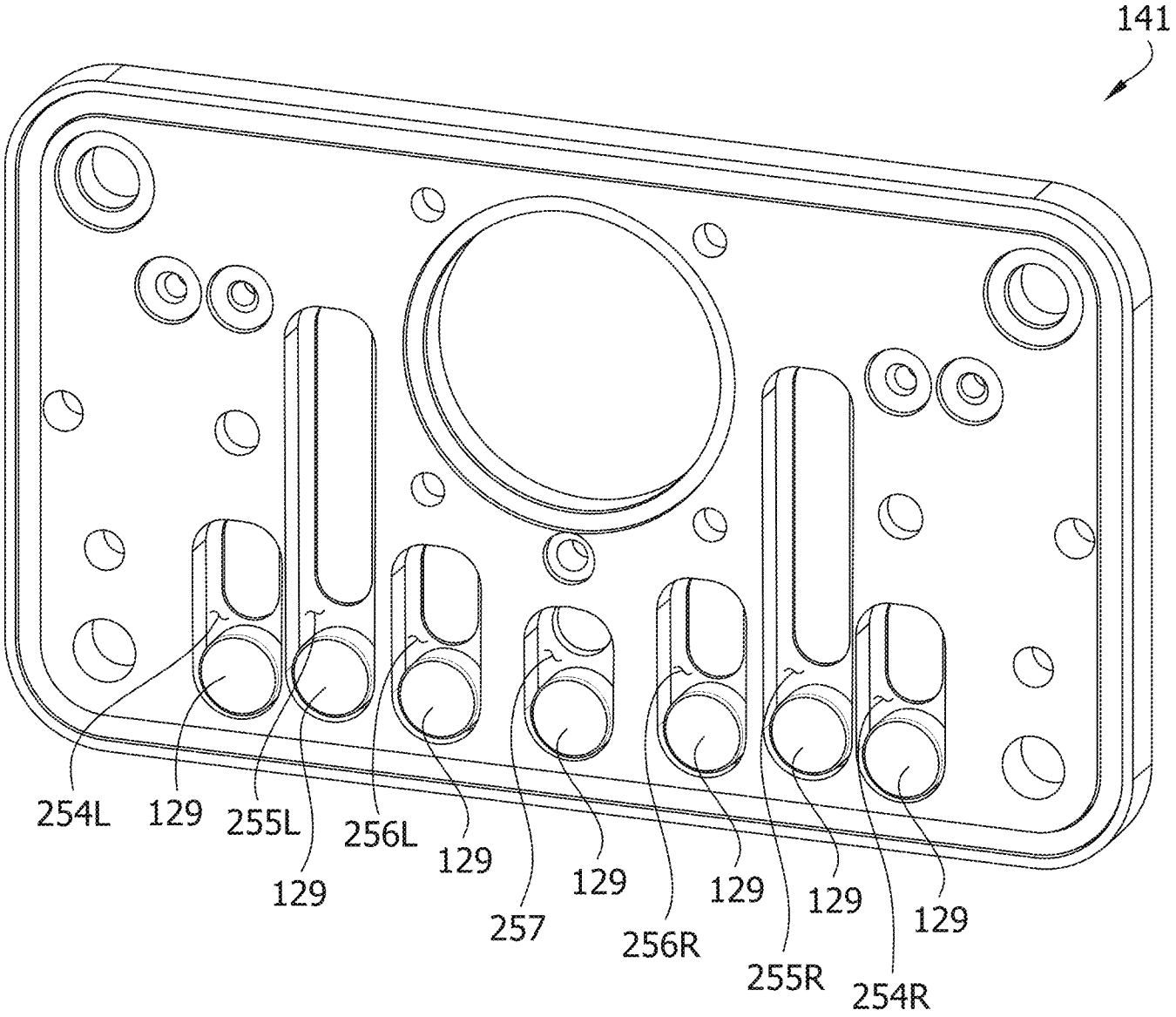
FIG. 18 is a photograph similar to FIG. 7 with the second housing member removed to illustrate the positions of the plugs in the inverted orientation.

The circular perimeter surface of each plug 129 is received between the left and right side portions of the respective primary groove 254L, 254R, 255L, 255R, 256L, 256R, 257 for rolling and/or sliding along the side portions of the primary groove, along the height RH1, RH2, RH3 of the respective race. Since the thickness PT and the diameter PD of each plugs 129 are smaller than the thickness and width of the primary grooves 254L, 254R, 255L, 255R, 256L, 256R, 257, the plugs are permitted to slide or roll along the heights RH1, RH2, RH3 of the races as the orientation of the shutoff valve assembly changes in use. For example, when the orientation of the shutoff valve assembly 101 changes from upright to inverted, the plugs 129 roll from respective upright positions (FIG. 17) adjacent the first end portions of the races, to respective inverted positions (FIG. 18) at the second end portions of the races. Because the side portions of the primary grooves 254L, 255L, 256L, 254R, 255R, 256R, 257 are sloped with respect to the vertical center axis VCA of the shutoff valve body, the round plugs 129 will tend to roll along the side portions of the primary groove walls, even when the shutoff valve body is only inverted about 90° from the horizontal orientation In the inverted position (FIG. 18), the plugs 129 are sized and arranged to block the passages 114L, 114R, 115L, 115R, 116L, 116R, 117. When the plugs are positioned in the second end portions of the races 124L, 124R, 125L, 125R, 126L, 126R, 127 as shown in FIGS. 6, 7, and 18, they inhibit liquid flow through the shutoff valve passages 114L, 114R, 115L, 115R, 116L, 116R, 117. Thus, when the carburetor 1 becomes inverted and the plugs 129 slide from the first end portions of the primary grooves 254L, 254R, 255L, 255R, 256L, 256R, 257 to the second end portions, the plugs subsequently inhibit fuel from leaking out of the fuel bowls 3 through the shutoff valve passages 114L, 114R, 115L, 115R, 116L, 116R, 117.

Thus, it can be seen that in use the shutoff valve assemblies 101 provide protection against fuel leaks that might be caused by inversion of the carburetor 1. With the shutoff valve assemblies 101 installed between the meter blocks 6 and the main body 2, the carburetor 1 can operate normally in the upright orientation to deliver a fuel-air mixture to a vehicle engine. When the carburetor 1 is in use, the plugs 129 remain seated in their upright positions shown in FIGS. 4, 5, and 17. The main fuel supply passages 115L, 115R are pressurized by the flow of fuel from the fuel bowls 3 into the main body 2 of the carburetor. But because the main fuel supply races have relatively tall heights RH1, the respective plugs 129 are seated at a position that is spaced apart from the pressurized main fuel supply passages 115L, 115R by a substantial distance. As a result, the pressure in the fuel supply passages 115L, 115R is attenuated at the bottom end portions of the races 125L, 125R and does not cause the plugs 129 to move upward along the heights RH1 of the races 125L, 125R in use.

When a rollover accident occurs that causes the carburetor 1 to rotate about a horizontal axis from the upright position by at least about 90°, each of the plugs 129 moves along the height RH1, RH2, RH3 of the respective race from the upright position to the inverted position, where it blocks fluid flow through a respective passage 114L, 114R, 115L, 115R, 116L, 116R, 117. More specifically, the round plugs 129 roll or slide along the side portions of the primary grooves 254L, 254R, 255L, 255R, 256L, 256R, 257 of the first housing member 141 and the outer wall of the second housing member 143 to the inverted position (FIG. 18). In the inverted position, the plugs 129 are positioned to partially or completely block fluid flow through the passages 114L, 114R, 115L, 115R, 116L, 116R, 117 and thus limit the amount of fuel that leaks from the fuel bowls 3 out of the carburetor 1.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained. As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A rollover shutoff valve assembly for being installed in a carburetor comprising a valve body defining at least one fluid passage and at least one race and a plug movably received in the race, the race being configured to guide movement of the plug from a first position in which the plug is spaced apart from the passage to a second position in which the plug is received in the passage to inhibit liquid flow through the passage when the shutoff valve assembly rotates from an upright position to an inverted position, the race being closed except at the passage, wherein the shutoff valve body is configured to be operatively installed between a meter block and a main body of a carburetor.

2. The rollover shutoff valve assembly as set forth in claim 1 wherein the race has a floor and a recess in the floor that is free of contact with the plug thereby to reduce frictional interaction of the plug with the valve body in the race as the plug moves along the race.

3. The rollover shutoff valve assembly as set forth in claim 1 wherein the valve body comprises a first housing member and a second housing member in engagement with each other so that the plug is captured between the housing members.

4. The rollover shutoff valve assembly as set forth in claim 3 wherein each of the first and second housing members has a peripheral edge margin in opposed relation with the peripheral edge margin of the other of the first and second housing members, the rollover shutoff valve assembly further comprising a gasket compressed between the peripheral edge margins to seal the peripheries of the first and second housing members.

5. The rollover shutoff valve assembly as set forth in claim 4 wherein the first and second housing assemblies define a power valve opening, and wherein the rollover shutoff valve assembly further comprises a power valve opening gasket engaging the first and second housing members around the power valve opening to seal an entire perimeter of the power valve opening.

6. The rollover shutoff valve assembly as set forth in claim 5 wherein the first and second housing members further define at least one curb-idle discharge passage, the rollover shutoff valve assembly further comprising a curb-idle discharge passage gasket engaging the first and second housing members around the curb-idle discharge passage to seal an entire perimeter of the curb-idle discharge passage.

7. The rollover shutoff valve assembly as set forth in claim 6 wherein the first and second housing members further define at least one curb-idle transfer slot passage, the rollover shutoff valve assembly further comprising a curb-idle transfer slot passage gasket engaging the first and second housing members around the curb-idle transfer slot passage to seal an entire perimeter of the curb-idle transfer slot passage.

8. The rollover shutoff valve assembly as set forth in claim 7 comprising mounting openings in the first and second housing members, fasteners received in the mounting openings, and a mounting opening gasket engaging the first and second housing members around the mounting opening to seal an entire perimeter of the mounting opening.

9. The rollover shutoff valve assembly as set forth in claim 8 wherein at least one of the mounting openings is free of a gasket.

10. The rollover shutoff valve assembly as set forth in claim 8 wherein the first and second housing members have corners and the mounting openings are disposed in at the corners.

11. The rollover shutoff valve assembly as set forth in claim 10 wherein when the rollover shutoff valve assembly is in an upright position, lower ones of the mounting openings have the mounting opening gaskets and upper ones of the mounting openings are free of mounting opening gaskets.

12. The rollover shutoff valve assembly as set forth in claim 1 wherein the race has at least one side that is sloped with respect to a vertical axis of the shutoff valve body.

13. The rollover shutoff valve assembly as set forth in claim 1 wherein the shutoff valve body defines an air bleed passage, a fuel supply passage, an air bleed race aligned with the air bleed passage, and a fuel supply race aligned with the fuel supply passage, the fuel supply race being longer than the air bleed race.

14. The rollover shutoff valve assembly as set forth in claim 1 wherein the race is defined by a groove formed in the shutoff valve body.

15. The rollover shutoff valve assembly as set forth in claim 1 in combination with the carburetor.

16. The rollover shutoff valve assembly as set forth in claim 1 in a kit further including screws sized for mounting the valve assembly and a meter block on the carburetor.

17. A rollover shutoff valve assembly for being installed in a carburetor comprising a valve body defining at least two fluid passages and at least two races and a plug movably received in each of the races, each race being configured to guide movement of the corresponding plug from a first position in which the plug is spaced apart from the respective fluid passage to a second position in which the plug is received in the respective fluid passage to inhibit liquid flow through the passage when the shutoff valve assembly rotates from an upright position to an inverted position, the races being closed except at the fluid passages.

18. The rollover shutoff valve assembly as set forth in claim 17 wherein the at least two races each comprises a groove formed into the valve body.

19. The rollover shutoff valve assembly as set forth in claim 17 wherein the at least two races have different lengths.

* * * * *